US008702018B1

(12) United States Patent
Rivera

(10) Patent No.: US 8,702,018 B1
(45) Date of Patent: Apr. 22, 2014

(54) UNIVERSAL SUDS-MIX FLUIDIC-CIRCUIT BUBBLIZER-CHAMBER

(76) Inventor: Santiago Rivera, Chula Vista, CA (US)

( * ) Notice: Subject to any disclaimer, the term of this patent is extended or adjusted under 35 U.S.C. 154(b) by 49 days.

(21) Appl. No.: 13/200,311

(22) Filed: Sep. 23, 2011

(51) Int. Cl.

| | |
|---|---|
| ***A62C 5/02*** | (2006.01) |
| ***B05B 7/06*** | (2006.01) |
| ***A62C 5/00*** | (2006.01) |
| ***B05B 7/26*** | (2006.01) |
| ***B05B 7/28*** | (2006.01) |
| ***B01F 5/04*** | (2006.01) |

(52) U.S. Cl.
USPC ..... 239/310; 239/311; 239/316; 239/317; 239/318; 137/888; 137/892

(58) Field of Classification Search
USPC ..... 239/318, 316, 9, 70, 74, 303, 305, 313, 239/310–350
See application file for complete search history.

(56) References Cited

U.S. PATENT DOCUMENTS

| | | | | | |
|---|---|---|---|---|---|
| 2,609,232 | A | * | 9/1952 | Taulman | 239/305 |
| 3,231,200 | A | * | 1/1966 | Heald | 239/318 |
| 3,486,695 | A | * | 12/1969 | Novak | 239/70 |
| 3,612,355 | A | * | 10/1971 | Stucky | 222/135 |
| 3,713,585 | A | * | 1/1973 | Conklin | 239/307 |
| 3,720,352 | A | * | 3/1973 | Kozlowski | 222/132 |
| 3,917,172 | A | * | 11/1975 | O'Hare | 239/305 |
| 4,019,658 | A | * | 4/1977 | Consaul | 222/144.5 |
| 4,193,520 | A | * | 3/1980 | Duffield | 222/133 |
| 4,200,206 | A | * | 4/1980 | Chase et al. | 222/144.5 |
| 4,218,013 | A | * | 8/1980 | Davison | 239/74 |
| 4,219,158 | A | | 8/1980 | Lacy | 239/305 |
| 4,295,612 | A | * | 10/1981 | Betsinger et al. | 239/310 |
| 4,432,105 | A | * | 2/1984 | Pitroda | 239/303 |
| 4,840,311 | A | * | 6/1989 | Shamblin | 239/74 |
| 4,881,575 | A | * | 11/1989 | Smith | 137/889 |
| 5,071,070 | A | * | 12/1991 | Hardy | 239/311 |
| 5,135,173 | A | * | 8/1992 | Cho | 239/305 |
| 5,174,503 | A | * | 12/1992 | Gasaway | 239/307 |
| 5,333,789 | A | * | 8/1994 | Garneys | 239/318 |
| 5,564,629 | A | * | 10/1996 | Weissman et al. | 239/8 |
| 5,716,005 | A | * | 2/1998 | McMahan | 239/315 |
| 5,842,645 | A | | 12/1998 | Degongre | 239/312 |
| 5,915,622 | A | * | 6/1999 | Foote | 239/10 |
| 5,950,928 | A | * | 9/1999 | Giang et al. | 239/304 |
| 6,000,626 | A | | 12/1999 | Futo | 239/74 |
| 6,012,649 | A | * | 1/2000 | Riddell et al. | 239/307 |
| 6,041,971 | A | * | 3/2000 | Pineda | 222/135 |
| 6,279,836 | B1 | * | 8/2001 | Toetschinger et al. | 239/70 |
| 6,421,847 | B2 | * | 7/2002 | Berke et al. | 4/615 |
| 6,859,955 | B2 | * | 3/2005 | Hudson | 4/601 |
| 6,923,384 | B2 | * | 8/2005 | Cernik | 239/318 |

(Continued)

*Primary Examiner* — Len Tran
*Assistant Examiner* — Alexander M Valvis
(74) *Attorney, Agent, or Firm* — Robert W. VonHeck; Inventech

(57) ABSTRACT

An apparatus providing improved dispensing of liquid-additives such as soap, shampoo, or bodywash, into an existing waterline outlet in bathroom or kitchen, while optionally featuring a unique Bubblizer™-chamber enabling user to observe an eye-catching dynamic fluidic-admixture display via a 2-inch diameter preview-window, prior to emergence of the bubblized-admixture via a conventional showerhead. The SudsMix™ shower-unit version readily suspends from an existing wall-extending gooseneck-pipe where it fluidicly couples into the water-line without aid of tools. Introduction of the liquid-soap additive is initiated remotely via a push-button valve conveniently located at waist-level, while concealed conduit-lines feed selected additive upward from the reservoir-section to the Bubblizer™-chamber integrated into the upper portion of the wall-hugging housing. Other adaptations of the Bubblizer™-chamber are a hand-held wand-like bathing back-scrubber, and similar kitchen-sink dish-scrubber.

20 Claims, 6 Drawing Sheets

(56) References Cited

U.S. PATENT DOCUMENTS

| | | | | |
|---|---|---|---|---|
| 6,926,212 | B1 * | 8/2005 | Glass | 239/318 |
| 6,991,184 | B2 * | 1/2006 | Romaine | 239/318 |
| 7,011,234 | B2 * | 3/2006 | Stradella | 222/129 |
| 7,028,922 | B2 * | 4/2006 | Leonard et al. | 239/318 |
| 7,073,215 | B1 * | 7/2006 | Berke et al. | 4/628 |
| 7,155,758 | B1 * | 1/2007 | Berke et al. | 4/675 |
| 7,201,331 | B2 | 4/2007 | Bertrand | 239/318 |
| D543,752 | S * | 6/2007 | Jones, Sr. | D6/545 |
| 7,320,438 | B1 * | 1/2008 | Latin et al. | 239/310 |
| 7,837,132 | B2 * | 11/2010 | Mazooji et al. | 239/263.1 |
| 7,866,572 | B2 * | 1/2011 | Ichige | 239/428.5 |
| 8,070,074 | B2 * | 12/2011 | Craig | 239/310 |
| 2006/0011746 | A1 * | 1/2006 | De Simone | 239/311 |
| 2006/0021996 | A1 * | 2/2006 | Scott et al. | 222/145.5 |
| 2007/0158470 | A1 | 7/2007 | Taylor | 239/428.5 |
| 2010/0051719 | A1 * | 3/2010 | Carlucci et al. | 239/316 |

* cited by examiner

FIG.-2A
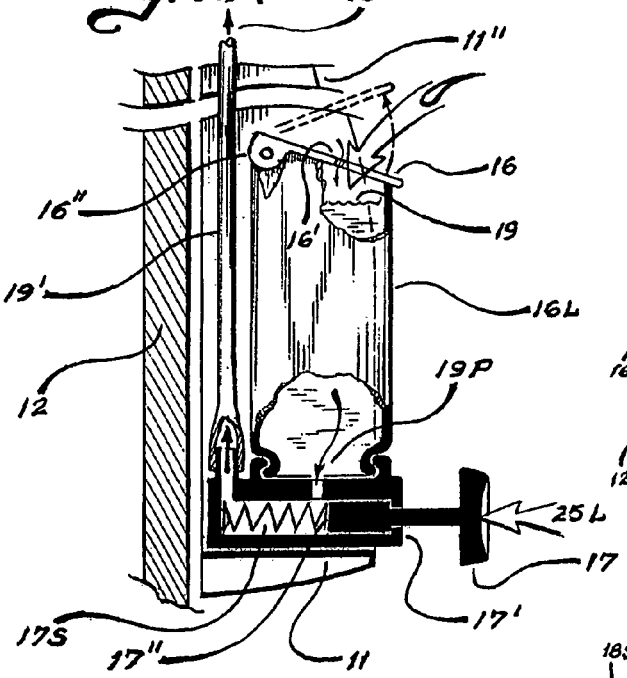
FIG.-2B
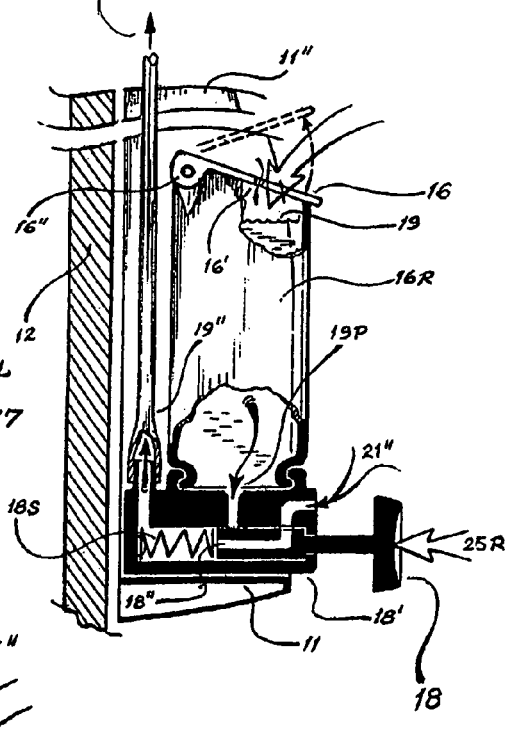
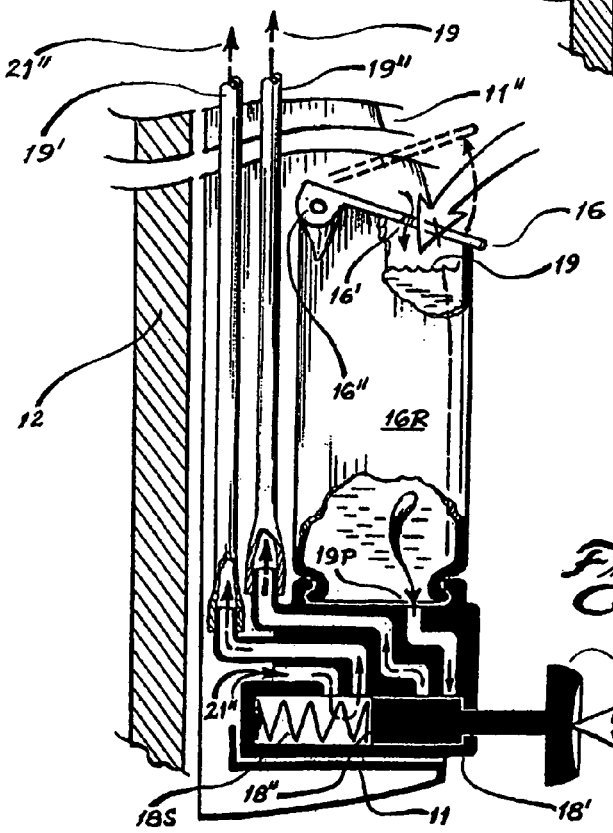
FIG.-2C

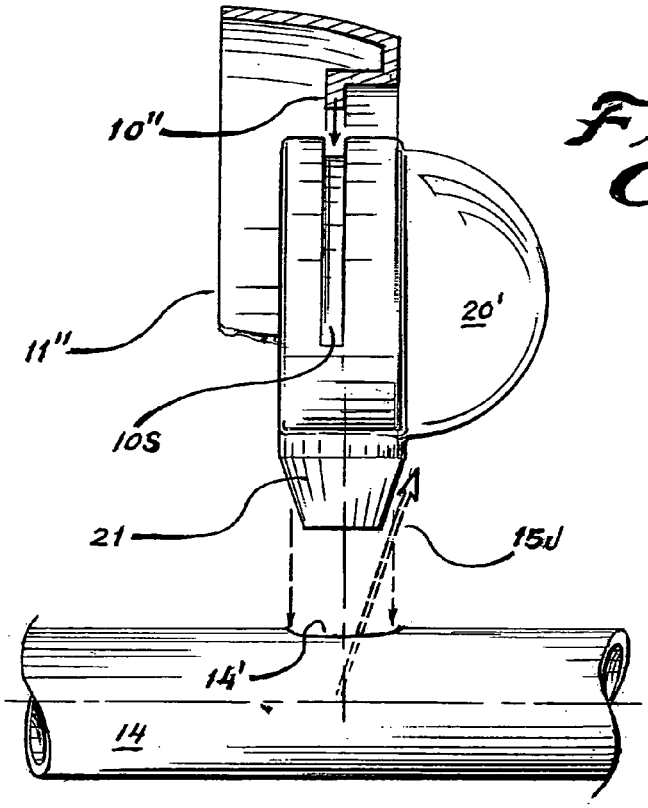
Fig.~4A
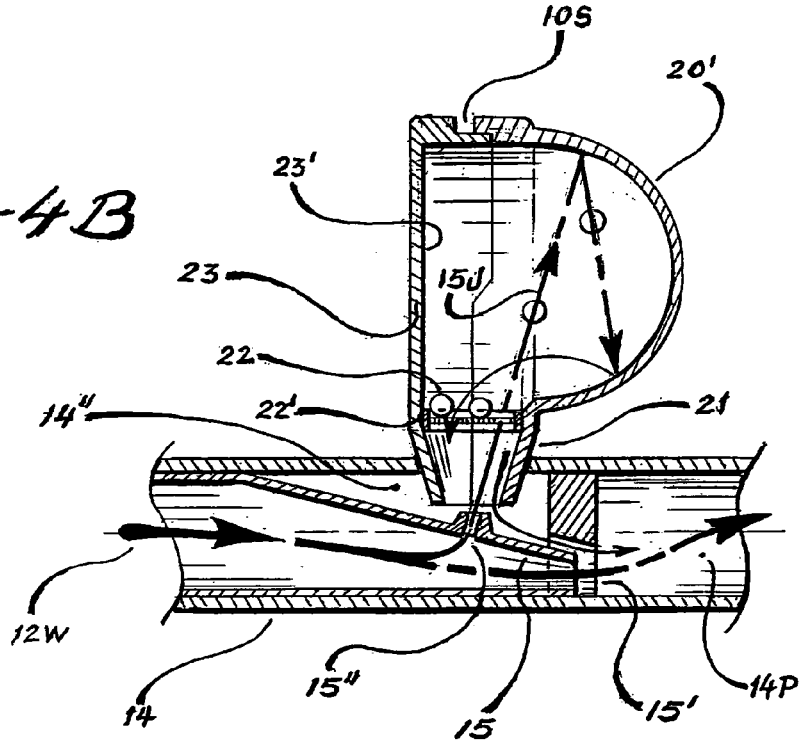
Fig.~4B

UNIVERSAL SUDS-MIX FLUIDIC-CIRCUIT BUBBLIZER-CHAMBER

I.) BACKGROUND OF THE INVENTION

1. Field of Invention

This invention disclosure relates to means for conveniently introducing a soap like liquid-agent into a pressurized water-line, and exhibiting the admixture prior to exiting a shower-head or washing-wand device; and more specifically, this disclosure relates to such types of apparatus employing either positive-pressure or negative-pressure for inducing such liquid-agent. Note also, that this new disclosure does not rely upon Applicant's earlier disclosures identified as U.S. patent application Ser. No. 06/233,932 (filed: 12 Sep. 2000) entitled: "Universal Faucet & Shower Economizing Suds-mixer" entailing positive-pressure JO injection of liquid-agent into an existing standard pressurized waterline to a bathroom or kitchen; —and nor does this disclosure rely upon subsequent U.S. patent application Ser. No. 09/912,560 (filed: 26 Jul. 2001) entitled: "Shower Apparatus"; neither disclosures having eluded to any manner of bubblizer-chamber as is to now be presented herein.

2. Background of Invention

Bathing facilities are commonly provided for body cleansing and refreshing at home, sporting-clubs, motels, and hotels for example, —and because it does not require an initial time consuming drawing of water as does a bathtub, a stall-shower or tub-shower is generally preferred particularly in public-facilities, because it is regarded as more hygienic and conserving of water and heating energy. Nevertheless, soaking in a bathtub is considered by many to be more therapeutically relaxing, wherein the bather can simply pour-in their personally enjoyed substances such as essential bath-oil, mineral-salt, fragrance, or other additive for cleansing, toning or nourishing to one's skin.

Accordingly, it would be highly desirable if there could be provided a showering apparatus with associated convenient and reliable (ie: non-clogging) human-engineered functionality capable of facilitating in-waterline and optional in-hand dispensing of various types of bathing additive liquid-agents such as: —bathing gentle soap, hair-conditioner, shampoo, essential-oil, perfume, etc. Such an ideal showering apparatus would enable a user to select the time, and amount of introduction for any one selected substance; —yet critically, not contaminate a subsequently selected dispensing with residuals of a former selected dispensed additive. Moreover, it would be desirable if the resulting fluidic-circuit system and method of operation would be applicable not only to the bathroom, but with alternate use of detergent-soap, to the kitchen-sink water supply as well.

3. Relevant Prior-Art

For the purpose of this brevity in this disclosure, it will be appreciated that there have been numerous patents in which the fluidic system acts to introduce a liquid-agent into the water-stream after the water has left the pressurized waterline via the showerhead, thus such iterations are not being referenced owing their very different systemic characteristics. Thus owing the extensive background research discovery found relating to—'disbursal of at least one liquid-agent within a pressurized waterline, the ensuing prior-art patent references are regarded as germane to this disclosure.

Chronologically for example U.S. Pat. No. 3,713,585 (filed: September 1971) contemplates a fluidic system for pressurized-injection of one or more liquid-agents into the pressurized showerhead waterline at the wall header-pipe gooseneck; however, a major defect of this configuration resides in its mixing of soap and shampoo into a common mixing-chamber, whereby either of the substances tends to become undesirably contaminated via the residual remnant of the prior substance presence within the mixing-chamber, unesirably which would take awhile to become flushed clean by the ongoing flow of pressurized-water within the sealed mixing-chamber. The concept is nevertheless regarded as of advanced design relative to its contemporaries, and included the option of in-hand dispensing to increase its usefulness in FIG. 3.

In U.S. Pat. No. 4,219,158 (filed: June 1979) is shown another showerhead gooseneck is header-pipe mounted liquid-agent dispensing apparatus, which is rather much less versatile than the preceeding patent specimen, and which relies upon siphon-action to draw a single liquid-agent from the reservoir upon user's operation of valve control-arm handle 84.

In U.S. Pat. No. 5,135,173 (filed: April 1991) is shown another showerhead gooseneck header-pipe adapted dispensing apparatus for introduction of either soap or shampoo into the pressurized water-line; but the invention is seriously hampered by use of an awkwardly confusing ratcheted rotary-valve device (FIGS. 4 & 5) which sequences the mixing of water-pressure into admixture reservoir-chambers 13*a* or 13*b*; wherein the user is forced to remember which liquid-agent they last selected via pull of chain 28.

In U.S. Pat. No. 5,333,789 (filed: August 1992) is shown another showerhead gooseneck header-pipe soap dispenser apparatus, wherein the soap-canister 70 is hung from the wall header-pipe, while a water-pressure conduit 58 is fed into the top of the soap-container, and owing a pressure-differential resulting from restrictor-port 48, a second conduit 60 sends the admixture 66 back into the lower-pressure portion of the header-pipe adapter-manifold 30. The user is provided rudimentary control-valve 82 by which to operate he fluidic system.

In U.S. Pat. No. 5,452,825 (filed: February 1992) is shown a popular shower-wall mounting unit which conveniently presents a variety of liquid-agents within a hinged housing-cover holding discrete detachable and refillable containers. Each of the containers is inserted down into a discrete receptacle employing a dedicated pushbutton which discharges a metered amount of liquid-agent into bather's hand via a downspout, before self-returning to outwardly aligned standby position. However, there is no anticipation nor adaptive to means capability enabling the positive-pressure fluidic dispensing pump feeds to be routed remotely as to provide additional convenience.

In U.S. Pat. No. 5,842,645 (filed: May 1996) is shown a somewhat more relevant showerhead gooseneck header-pipe adapted apparatus for dispensing of two different liquid-agents such as soap and shampoo. However, the apparatus does not actually inject either of the liquid-agents so as to flow from the showerhead itself, but rather diverts the water-pressure into a pre-chamber (not identified by indicia numeral) which is immediately above a smaller adjoining chamber identified as water-basin 10, from whence the foaming overflow is mostly foamy-lather 27 which gravitates out upon user via foam-spout 11. Accordingly, when main rotary-valve 33 is rotated by user from the fluidic flow off-position of FIG. 2d to the on-position revealed in FIG. 2c, all water flows through the sprayhead alone; but when said rotary-valve 33 is rotated as revealed in FIGS. 2a/2b all pressurized-water is caused to be diverted to flow through a small spray-nozzle directing thus agitating water into the ambient-air exposed foam-generating chamber (supplied with liquid-agents via gravity-flow from either user selected reservoir-1 or reservoir-1a). Hence, when user desires to partake of the lather modality of operation, water-flow via the sprayhead is interupted; nor is there provision for a liquid-agent to be dispensed into user's hand.

In U.S. Pat. No. 6,000,626 (filed: January 1998) is shown a hand-portable sprayer and soap-dispenser for connection to a pressurized water-line such as in a kitchen, for direct cleaning and rinsing of kitchen-utensils and associated sink environment; —all of which may be aided with the option of an attachable brush-ring scrubber accessory. However, while the arrangement of the thumb-actuated liquid-soap injection-pump 114 relative to the finger-operated water-control trigger 84, in association with the surrounding liquid-soap reservoir-chamber 168 (all indicated in FIG. 4) is technically well engineered, its configuration is less than practical from a functionality aspect of actual usage. For example, if one attempts to clean down inside a tall drinking-glass, it becomes readily apparent that one's own hand necessarily upon the operating controls becomes an impediment to efficient and effective access while endeavoring to clean residue from within the deeper recess of the vessel. Hence, while its inventors have placed strong emphases upon compact integration of components within the particular physical structure, closer study reveals the configuration to be substantially less than could be offered by way of an actual wand like embodiment having advantage of a deeper reach.

In U.S. Pat. No. 6,512,1847 (filed: June 1999, and later very similar disclosure U.S. Pat. No. 7,155,758 filed—July 2002) is shown a shower or kitchen/laundry liquid-agent dispenser, relying in a first-embodiment upon the use of a siphon-venturi suction delivery system, and in a second-embodiment relying upon a notably weaker gravity-fed delivery system.

In U.S. Pat. No. 6,926,212 (filed: April 2003) is shown a "Device for Adding Soap to a Water-inlet", comprising a liquid-soap injector-body 50 in fluid-communication with a manual pump-unit 14 capable of both drawing the liquid-soap from a reservoir 36, and at once sending a like dose of liquid-soap into the injector-body where through is flowing the main clear-water from the wall-header/gooseneck-pipe 5 and then outward via a conventional showerhead 6.

In U.S. Pat. No. 7,028,922 (filed: January 2004) is shown a venturi-siphon suction fluidic circuit cooperating via conduit 22 with a user operated disposable container as exemplified in FIGS. 4 & 5, whereto its user is required to apply downward pressure upon the inverted bottom of container 40, thereby said to open a valve releasing the liquid-agent 42 into fluid communication with the showerhead via conduit 22. However a critical impediment to the described performance has been overlooked, whereby it should be understood that once an initial downward pressure is applied to the inverted container of FIG. 5, a disruptively untenable negative back-pressure condition is created progressively within container 40 as the liquid-agent 42 becomes evacuated therefrom. Because there is no neg.-pressure relief-port (would need to be a one-way check-valve provision, or just a vent-hole if relying only upon gravity feed) means provided for ambient-air to enter and occupy the space once occupied by displaced liquid-agent 42, the self-defeating negative back-pressure resulting within container 40 would soon act to oppose intended sending of liquid-agent 42 no matter how forcefully the user pressed down upon the container. Unfortunately, the inventor's contentions are rendered inherently defective by claiming an unworkable apparatus; although it seems unclear if the inventor was merely trying to employ gravity-flow from the container 40, or was the inventor attempting to induce pos.-pressure via the plunger-like action of container 40 (either way, a problematical cavitation effect appears to defeat its function).

In U.S. Pat. No. 7,201,331 (filed: December 2000) is shown a seemingly ordinary venturi-siphon suction device to draw liquid-agents such as soap or shampoo into the existing wall gooseneck header-pipe water-flow. As the notion of employing a line restrictor orifice 15 stepping out into an enlarged chamber portion 15 in conjunction with a lateral siphon-duct feed is not new, apparently the novelty of this particular siphon device resides in its specific one-piece configuration in combination with an integral showerhead socket-ball.

In pending US.Pat.#2007/0158470 (filed: November 2006) is shown an 'Oxygenating Showerhead' which longitudinal-axis includes a coaxial siphon-nozzle device and an anti-chamber surround thereto where is included a metering-valve for variable inleting ambient-air into the anti-chamber, whereby air is finally drawn into a forward mixing-chamber where the water and air together impact a fixed plate, thereby causing a splattering-action swirling the fluids concealed within the mixing-chamber, whereupon the said resultingly super-oxygenated water freely flows outwardly upon the bather via the numerous conventional showerhead outlet-holes.

In pending US.Pat.#2010/0051719 (filed: August 2008) is shown a "Showerhead Dispenser' which water-inlet is secured to the outlet of a wall-goosneck pipe; and whereby water is sent into mixing-chamber within the showerhead; and, whereto a conduit also arranged in fluid-communication with the mixing-chamber. Accordingly, while main waterline clear-water is flowing into the mixing-chamber, the bather may depress a pump-lever forcing a liquid-agent such as a liquid-soap to become injected into the clear-water impacting a splatter-plate located within the fore-center of the showerhead, thereby causing bubbly-soap to exit the spraynead onto the bather. Generic variations include plural liquid-agent containers, in combination with concentric mixing-chambers within the showerhead.

Therefore, in consideration of the preceding patents review, it is concluded that no where in the prior-art does there exists a means by which the user can visually preview the process of introducing a liquid-agent into the water-stream within a chamber prior to exiting the showerhead. Hence, it has been determined that there is a viable need for an improved form of product to which these patents have been largely addressed. The instant inventor hereof believes their newly improved shower and kitchen fluidic-circuit apparatus referred to as the SudsMix™, currently being developed for production under auspices of—'Rivera Fluidics Mfg./Mkt.Co.', exhibits certain novel advantages as shall be revealed in the subsequent portion of this instant disclosure.

II.) SUMMARY OF THE INVENTION

In view of the foregoing discussion about the earlier invention art, it is therefore important to make it pellucid to others interested in the art, that the object of my universal SudsMix™ invention is to provide an improved fluidic-circuit apparatus and method by which to facilitate the convenient dispensing of one or more liquid-agent products such as various commercially available liquid-agents (ie: soap, shampoo, emollient, etc.) via a conventional bathroom showerhead, or generic variant embodiment in the form of a hand-held washing-wand for use in the bath, kitchen, or even a variation for use as a car-washing wand; plus my invention can be adapted to the spigot portion of a bathroom-basin or kitchen-sink faucet as well.

Despite the array of precedingly discussed showerhead related soap-additive apparatus, our survey found it surprisingly difficult to find such showering products readily available in the retail-marketplace. Indeed, we found only a few popular liquid-agent dispensing products for the home-bathroom; —such as marketed by Canadian-firm Better Living-Products Co. which product is based upon U.S. Pat. No. 5,452,825, and another similar Asian-made bathroom-shower dispenser named Aviva. Both dispensers employing plural gravity-feed containers, each arranged above a discrete positive-pressure pushbutton-actuator, which have proven reliable for dispensing down into the bather's cupped-hand, neither of these well designed products suffer from the problematical arrangement of merely opening a valve-port to enable gravity-feed which is quite prone to clogging. Yet no apparatus could be found in the vast retail-marketplace which would actually enable the user to introduce a liquid-agent, such as soap or shampoo, prior to the water flowing from the showerhead.

A.) Accordingly, the foremost objective of my SudsMix™ invention is to provide an improved fluidic-circuit, a system in which one or more liquid-agents can be discretely introduced into the water-stream of a showerhead's gooseneck-pipe or kitchen water outleting plumbing fixture for example, via at least one manually actuated push-button(s) acting to deliver a metered or measured dose of liquid-agent into a special non-pressurized 'bubblizer-chamber' arranged generally abaxially to the longitudinal flow of the primary clear-water flowing through the gooseneck-pipe of a stall-shower for example. Note that while merely dispensing liquid-agent down into one's hand is easily performed, trial users of my earlier R&D evaluation prototype units sometimes expressed objection to the greatly increased effort required to inject a liquid-agent when dispensing into the highly pressurized waterline (ordinarily ranging from 80 psi to 160 psi) associated with an ordinary house or apartment building plumbing system.

Therefore, I have devised a simple and inexpensive means by which to attain a desired great reduction of effort involved in manually introducing the liquid-agent into the fluidic-circuit which, according to engineering-design choice, enables me to employ either a positive-pressure pushbutton feed, or employ a negative-pressure feed of liquid-agent. My novel fluidic-circuit serves to circumvent the primary high-pressure main-stream of clear-water flowing through the fluidic-circuit, thereby totally overcoming the problematical effort, whereby even a child can easily actuate the liquid-agent pushbutton.

B.) In principle, my special bubblizer-chamber system basically works in cooperation with an elongate housing apparatus employing an inlet connected to an existing water-line source, and an outlet generally arranged at the opposite distal end along a basically longitudinal-axis (—which can have an arched shape) that provides a through passageway for the primary water-flow, this flow-path includes a substantially conventional preferably coaxial type siphon-nozzle device, featuring a special right-angle diverter-port nominally of about 1/32nd. to 3/32nds.-inch diameter, which sends a constant agitator-jet of clear-water up into the abaxial bubblizer-chamber via an aspirating-port. This diverted water then immediately drains out of the bubblizer-chamber via gravity through the aspirating-port into an anti-chamber, where it is drawn back into the primary stream of clear-water flow, and finally outward such as via a conventional showerhead; —thereby constituting a 1st-mode of operation wherein no liquid-agent (—generally soap) is induced into the bubblizer-chamber.

However, in a selective 2nd-mode of operation, a liquid-additive contained within a remote reservoir section, is sent via a discrete conduit to the bubblizer-chamber upon selective manual biasing of a pushbutton operated normally-closed valve, thereby delivering a dose of the liquid-additive into the bubblizer-chamber where it becomes mixed as an admixture by the agitator-jet, the admixture then draining into the mentioned anti-chamber where it is drawn by the siphon-nozzle back into the primary stream of water flow; whereupon the now effervescently bubblized water emerges from the showerhead. Although this explanation defines the fundamental function of my novel fluidic-circuit, there are detail generic variations which are best explained later via clarifying illustrations.

C.) Another object of this SudsMix™ invention is to enable the bather to actually observe the novel bubblizing-action within the bubblizer-chamber via a transparent preferably approximately 2-inch diameter hemispherically shaped preview window; —whereupon depressing the pushbutton-actuator releases a dose of liquid-soap, the bather instantly seeing the bubblizing-action taking place! This entertaining aspect is perhaps best described as akin to viewing the washing-action seen through the window of a side-loading cloths-washer when excessive soap has been added! Moreover, once the liquid-soap has been rinsed away by the on-going agiator-jet, the preferably protruding window portion of the bubblizer-chamber tends to darken noticeably upon absence of ambient-light refracting soap-bubbles therein. Another optional feature of my bubblizer-chamber is the provision of several tiny thin-walled transparent plastic flotation-balls, which when hit by force of the agitator-jet, are caused to dance around within the bubblizer-chamber, thereby providing an artificially enhanced visual illusion of soap-bubbles, which serves to accent the observed bubblizing action. Alternate use of very low-density/light-weight EPS (expanded-polystyrene closed-cell) white spherical-beads of ¼-inch nominal diameter, are caused to float upward upon the suds-bubbles to be observed within the bubblizing-chamber; —then once the liquid-soap becomes depleated within the bubblizer-chamber the flotation-balls merely settle back down substantially out of sight.

D.) Another object of my SudsMix™ invention disclosure is to set forth a method of previewing a novel bubblizing-action within a fluidic-circuit which is connected to an existing pressurized waterline, enabling the user to observe a novel bubblizing-action as has been outlined in preceeding items-A/B/C. Accordingly, it is necessary to provide a liquid-aditive reservoir arranged in descrete fluid-communication with a selectively actuatable pushbutton delivery-valve device feeding a bubblizer-chamber which cooperates with a siphon-nozzle having a divertor-port shooting a constant agitator-jet of clear-water into the bubblizier-chamber. This clear-water then drains into an anti-chamber where it is immediately drawn back into the primary water-stream and finally outward. The bather can thus actuate the pushbutton as to thereby send a dose of the liquid-agent into the bubblizer-chamber, which is provided with a transparent window wherein the bather can actually see the bubblizing-action being caused by the agitator-jet until the injected liquid-agent becomes depleted therein. The outwardly spring-biased pushbutton delivery-valve can be via a conventional pos.-pressure piston-action type device, or, it may be a substantially conventional spring-biased shuttle-valve type device using neg.-pressure (suction) generated at the remote siphon-nozzle; —either of which thus delivering a predetermined dosage of liquid-agent.

III.) DESCRIPTION OF THE PREFERRED EMBODIMENT DRAWINGS

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related matter stated in the text, as well as the Claims section annexed hereto; and accordingly, a better understanding of the invention and the variant uses is intended, by reference to the drawings, which are considered as primarily exemplary and not to be therefore construed as restrictive in nature; wherein:

FIG. 2A, is a semi-diagrammatic left/side-elevation view shown mostly in cut-away, wherein is exemplified the preferred arrangement of the liquid-agent reservoir container employing a positive-pressure type manual pushbutton plunger-valve;

FIG. 2B, is a semi-diagrammatic left/side-elevation view shown mostly in cut-away, wherein is exemplified the preferred arrangement of the liquid-agent reservoir container employing a negative-pressure type pushbutton shuttle-valve;

FIG. 2C, is a semi-diagrammatic left/side-elevation view shown mostly in cut-away, revealing an alternate embodiment of the liquid-agent reservoir container, wherein the momentary dispensing valve's defaulting first-position employs an ambient-air relief circuit 19' for aspirating the bubblizer-chamber; while also showing that when the valve is biased inward said ambient-air relief circuit becomes closed, whereupon a secondary circuit 19" opens, causing only said fluid-agent to be drawn into said bubblizer-chamber.

Figure 3A:
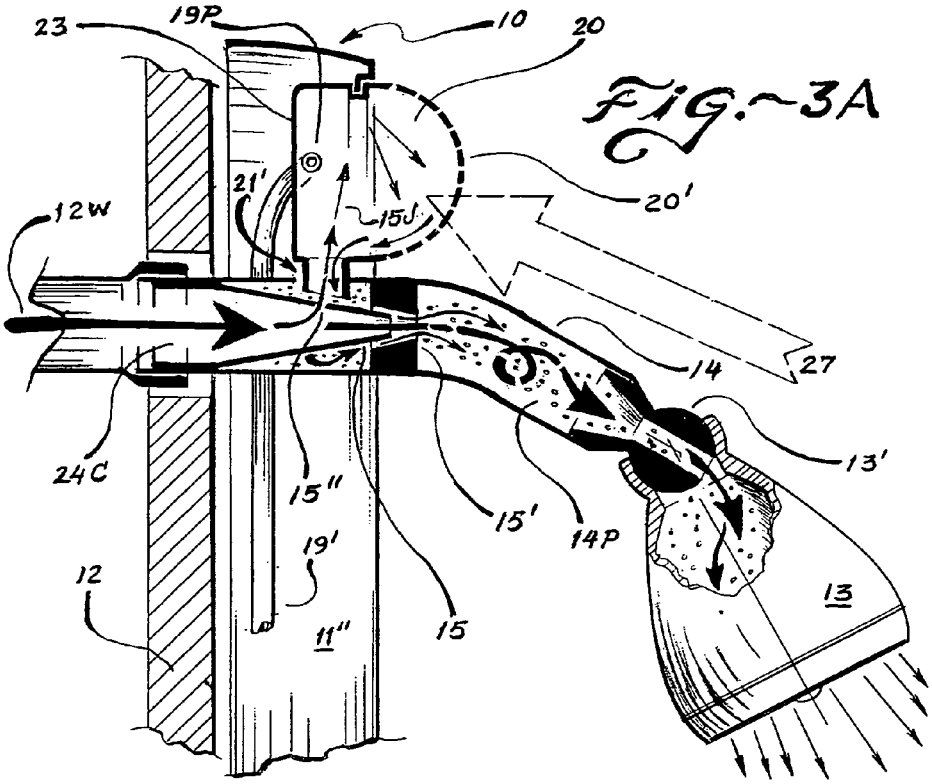
Figure 3B:
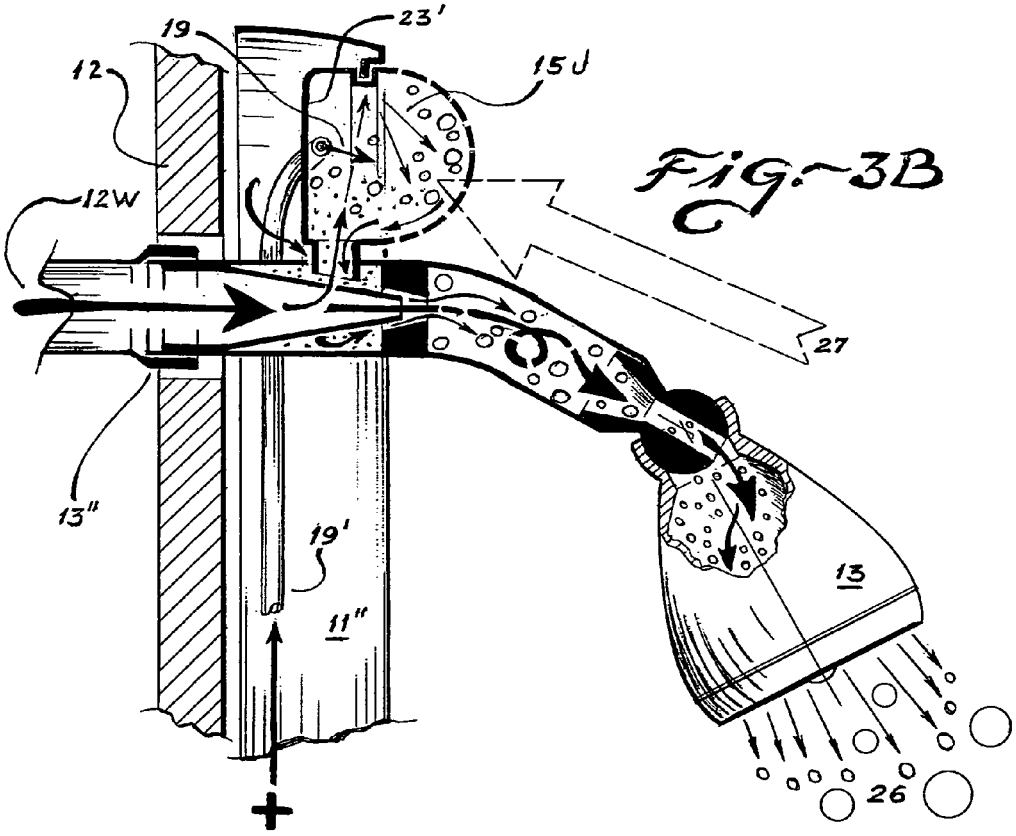
Figure 3C:
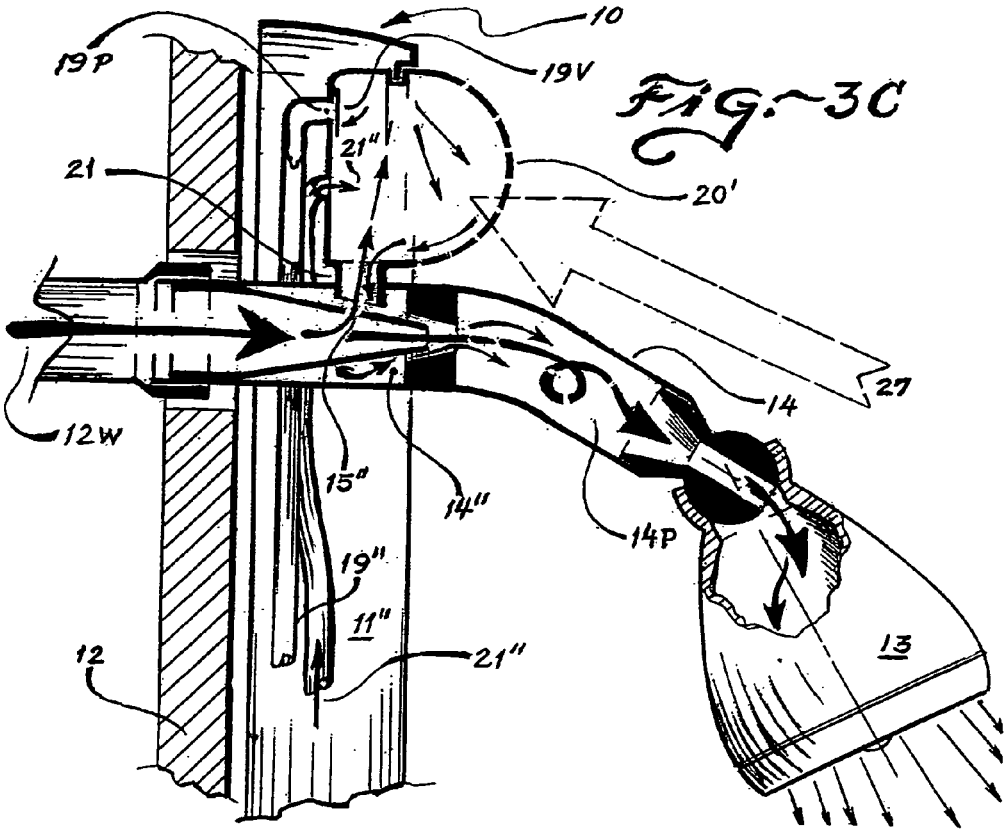
Figure 3D:
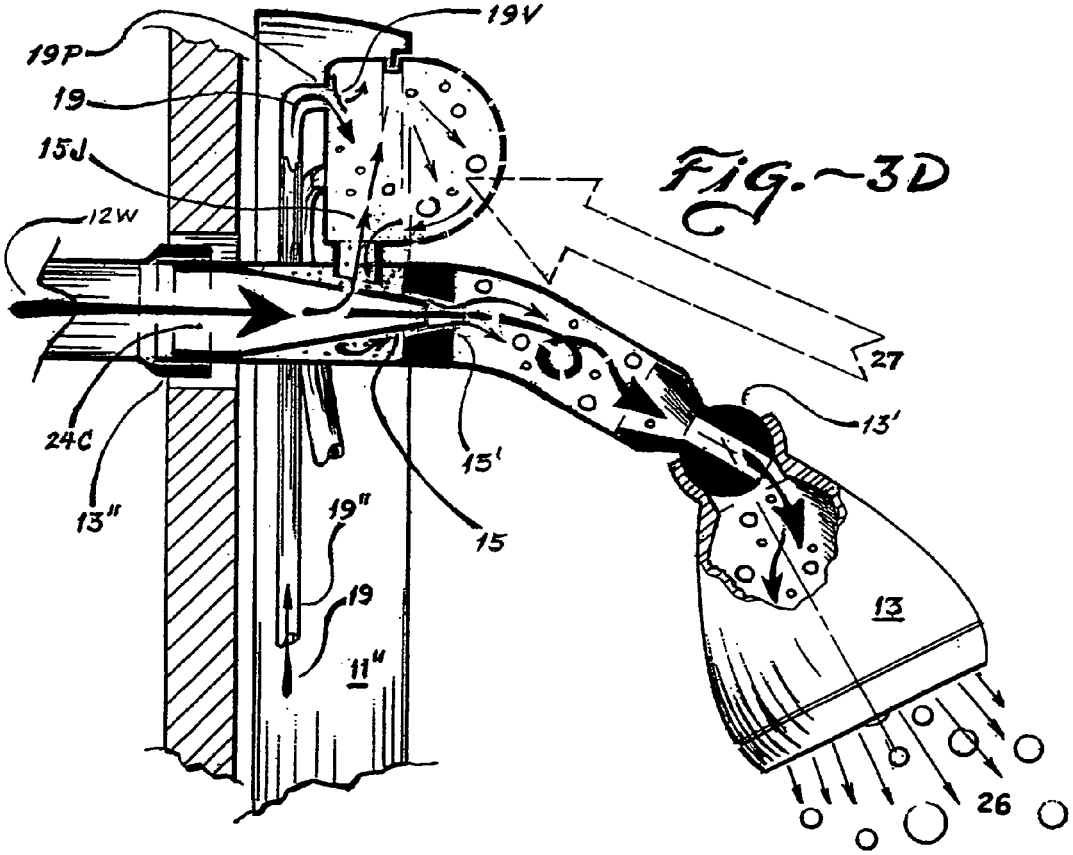
Figure 5:
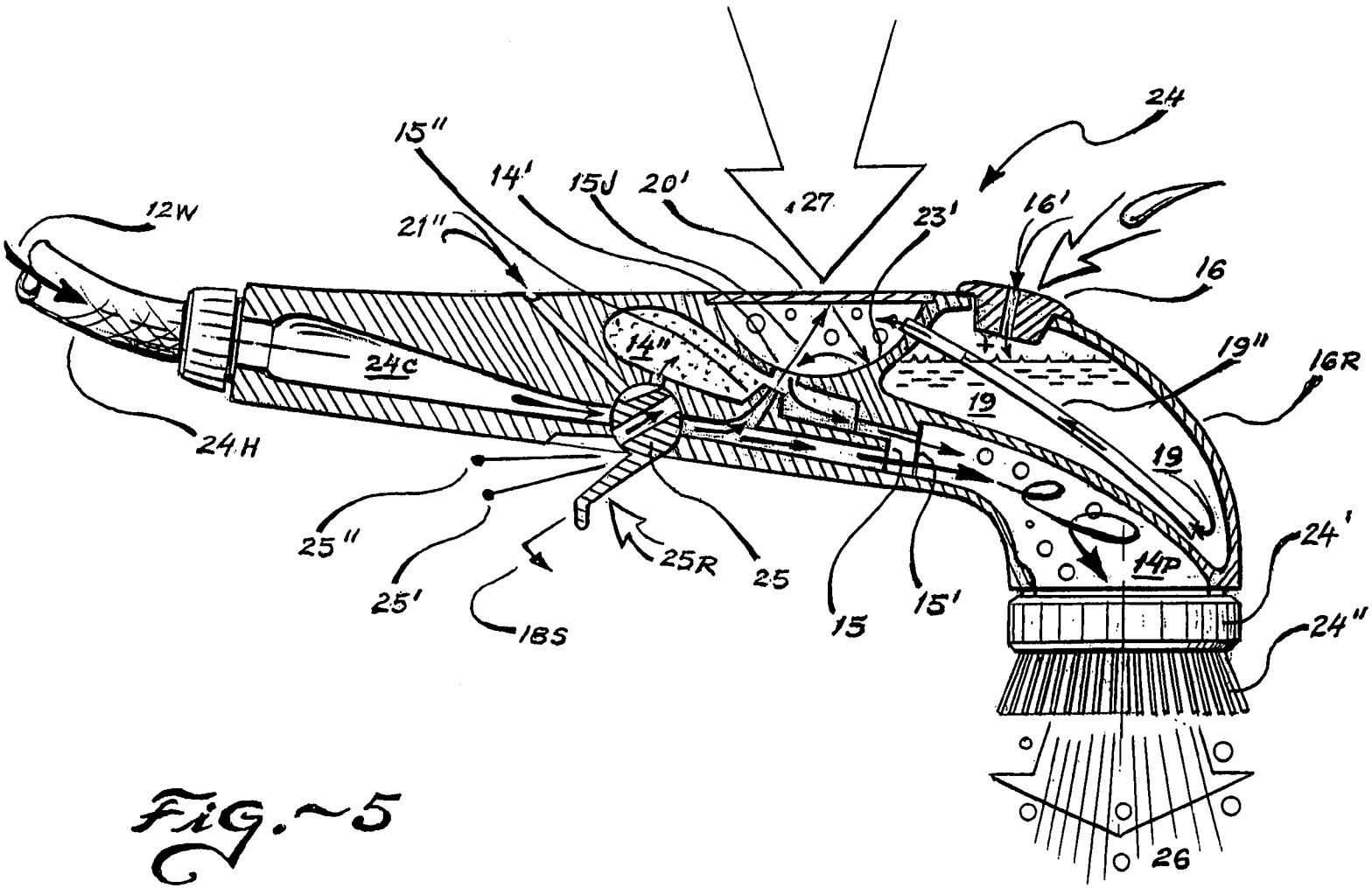

FIG. 3A, is a semi-diagrammatic left/side-elevation view shown mostly in cut-away, wherein is exemplified a fluidic-circuit associated with use of the pos.-pressure liquid-agent induction (here shown non-activated) of FIG. 2A relative to the bubblizer-chamber, whereto the protruding imperforate viewing-window portion is represented via broken phantom-line only to indicate it is preferably transparent;

FIG. 3B, is the identical embodiment shown according to FIG. 3A, wherein is demonstrated the fluidic-circuit action when the liquid-agent is actively introduced within the bubblizer-chamber via manual actuation of the FIG. 2A plunger-valve;

FIG. 3C, is a generic variant embodiment shown according to FIG. 3A, wherein is revealed the preferred configuration associated with use of the Neg.-pressure liquid-agent induction (here shown non-activated) of FIG. 2B relative to the bubblizer-chamber;

FIG. 3D, is the identical embodiment shown according to FIG. 3C, wherein is demonstrated the fluidic-circuit action when the liquid-agent is actively introduced within the bubblizer-chamber via manual actuation of the FIG. 2B shuttle-valve;

FIG. 4A, is a semi-diagrammatic left side elevation-view showing the bubblizer-chamber unit prior to drop-in attachment upon the gooseneck's aspirating-port of the shower embodiment of my invention, and note also the escaping adglator-jet plume;

FIG. 4B, is a 2nd-sequence of FIG. 4A shown in partial cut-away view, wherein is demonstrated how the bubblizer-chamber is preferably adapted to mount without aid of tools relative to the gooseneck-pipe;

FIG. 5, is a semi-diagrammatic left/side-elevation view in partial cut-away, wherein is shown a general rudimentary representation of my hand-held wand embodiment which lends itself to generic-variant adaptations for bath, kitchen, or car-washing.

IV.) ITEMIZED NOMENCLATURE REFERENCES

| | |
|---|---|
| 10, 10', 10", 10S- | shower hanger-bracket, display-aperture, mount-flange, mount-slot |
| 11, 11'/11", 11R- | reservoir shelf, hanger-arms: left/right, conduit-recess |
| 12, 12'/12", 12V- | existing shower-wall, waterpipe: hot/cold, standard faucet-valve |
| 13, 13', 13", 13A- | standard showerhead, ball & socket, standard coupling, annulus |
| 14, 14',14", 14P- | gooseneck-pipe, aspirating-port, anti-chamber, outlet-passage |
| 15, 15', 15", 15J- | siphon-nozzle, siphon-port, diverter-port, agitator-jet |
| 16L/16R, 16, 16', 16"- | reservoir container: left / right, refill-lid, vent-hole, lid-hinge |
| 17/17'/17", 17S- | Lt.-pushbutton actuator, plunger-valve, piston-head, return-spring |
| 18/18'/18", 18S- | Rt.-pushbutton actuator, shuttle-valve, shuttle-head, return-spring |
| 19/19'/19", 19P, 19V- | liquid-agent, delivery-conduit: left / right, feed-port, check-valve |
| 20, 20'- | bubblizer-chamber, viewing-window |
| 21, 21', 21"- | connector-neck, air-vent, air-inlet |
| 22/22'- | floatation-balls, strainer-screen |
| 23, 23'- | chamber rear-wall, reflective-substrate coating |
| 24, 24', 24", 24H, 24C- | scrubber-wand, brush-ring, bristles, flex-hose, header-chamber |
| 25, 25L/25R, 25'/25"- | rotary-valve, pushbutton ref.-arrows: Lt./Rt., lever stage: 1st/2nd |
| 26- | emitted bubblized water |
| 27- | observer's line-of-sight Ref.-arrow |

IV.) DETAILED DESCRIPTION OF THE PREFERRED EMBODIMENTS

Figure 1:
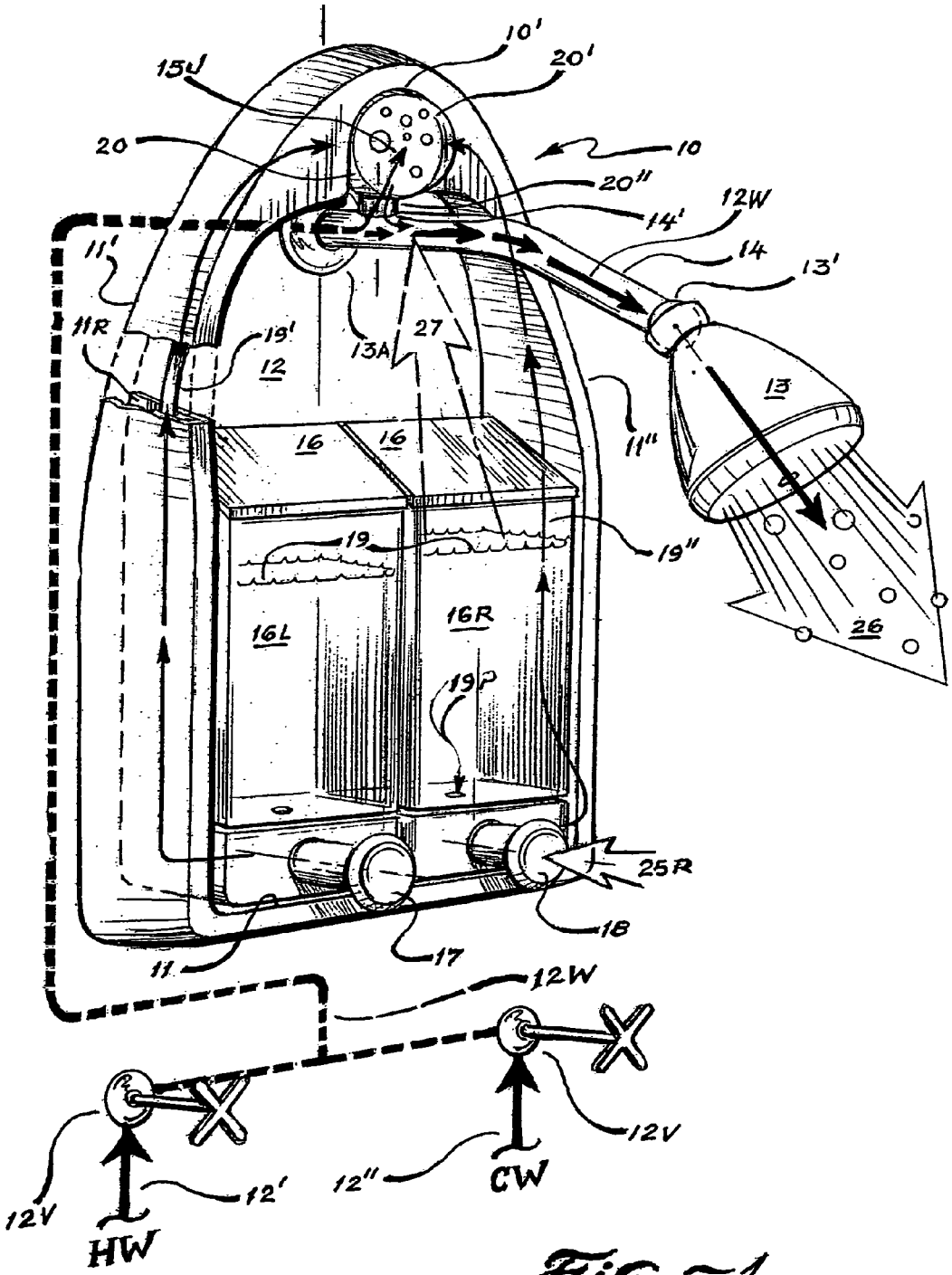
FIG. 1, is a rudimentary semi-diagrammatic left-oblique frontal perspective-view of my exemplified overall SudsMix™ shower-caddy assembly installation.

Initial reference is given by way of FIG. 1, wherein is exhibited a general pictorial representation of my overall SudsMix™ shower-caddy assembly comprising a unifying hanger-bracket 10 preferably configured as a one-piece molded-plastic housing-framework surround comprising a pair of vertically opposed left 11' and right 11" hanger-arms, while preferably positioned against existing shower-wall 12, and is suspended upon the typically horizontal portion of gooseneck-pipe 14 just inboard from the conventional showerhead 13. This assembly can be coupled to the gooseneck-pipe via conventional plumbing connectors, but is preferably mounted as shown by means of a special aspirating-port 14' into which connector-neck 21 is inserted; —thereby enabling the entire hanger-bracket assembly 10 to be conveniently lifted entirely away from fixed gooseneck-pipe 14 for occassional cleaning, —without need of tools. This handy lift-away feature advantageously allows the assembly to be rinsed-off with hot-water in a jiffy via a bathtub's ordinary lower spout (not shown), which hotel Room-maintenance appreciate, —as it greatly eases keep things looking spiffy in the many rooms they must service.

This FIG. 1 exemplified version of my SudsMix™ invention provides the bather with a pair of modularly designed liquid-agent reservoir containers 16L and 16R, each of which employ access-lids 16, which are preferably separate as to thereby help assure the correct liquid-agent 19 is refilled according to a lable (ie: soap, shampoo, body-wash, etc.) provided upon the lids 16. The containers can be provided with its own docking station, or the containers can simply rest as shown upon a reservoir shelf 11; in any case, the reservoir containers 16L and 16R are each preferably joined intimately down upon their respective dedicated pushbutton-actuators 17 (left) 18 (right), —thereby enabling direct gravity feed of respective liquid-agent 19 therein via their separate feed-ports 19P.

Note in FIG. 1 that a portion of the left hanger-arm is visually fragmented as to reveal how the normally unseen cross-sectional concave back-side passageway formed vertically as a conduit-recess 11R within both the hanger-arms 11'(left) and 11"(right), thereby serve to aesthetically conceal routing of discrete fluidic conduits 19' and 19" therein. These conduits are preferably standard ⅛-inch to ¼-inch I.D.(inside-diameter) transparent flexible vinyl-tubing (generally indicated in FIG. 1 via bold dashed-arrow lines) which deliver their respective liquid-agent 19 from the descrete lower left and right metering-pump actuator modules 17 and 18 respectively, up to remote left and right receiving tubing-nipples extending from exterior surface of the bubblizer-chamber 20.

Reference to FIGS. 2A/2B show the actuators 17 and 18 in greater detail, and serve to exemplify two practical albeit different fluidic methods of conveniently delivering the liquid-agent 19, via manual pushbutton action to the remote bubblizer-chamber 20 indicated in FIG. 1. The transparent plastic reservoir-containers 16L/16R are supported upon a common reservoir shelf 11, and are routinely refilled as needed via hinged 16" refill-lids 16; whereby the liquid-agent 19 is thus ready for delivery into the bubblizer-chamber 20 (FIG. 1). The cutaway illustration of FIG. 2A, exemplifies a positive-pressure delivery method, wherein a return-spring 17S has biased piston-head 17" outwardly as shown within the cylindrical-bore of plunger-valve body 17', thereby facilitating subsequent replenishing gravity-flow of the liquid-agent 19 into the bore of plunger-valve 17' via feed-port 19P which becomes occluded once piston-head 17" is manually biased (Ref. actuation-arrow 25L), forcing the liquid-agent 19 through the delivery-conduit 19' and up into the remote bubblizer-chamber 20.

Study of FIG. 2B presents the equally preferred example of a negative-pressure liquid-agent delivery system, wherein the feed-port 19P is normally occluded, and conversely to the example of FIG. 2A, thus becomes opened when the user actuates (Ref. actuation-arrow 25R) the piston like shuttle-port 18" within the enclosing body of shuttle-valve 18', whereupon a suction-action generated within this adaptation of the bubblizer-chamber 20 (indicated in FIG. 1) acts to draw the liquid-agent 19 upward via delivery-conduit 19'. Note also, in FIG. 2B the preferred option of auxiliary air-inlet 21", which is normally-open to feed ambient-air into the delivery-conduit 19" during normal non-delivery of liquid-agent 19 (per FIG. 3C); —which has been found to effectively serve as a water economizer technique, whereby the air thus induced into the gooseneck-pipe aids in boosting the apparent water-flow experienced by the bather (ie: the water-flow combined with the induced air, has been discovered to send the outflow of water from showerhead 13 with an approximate 15%-greater thrust)! Hence, when the bather depresses pushbutton 25R, the air-inlet 21" becomes blocked by action of the shuttle-valve 18', whereby the on-going suction generated by remote siphon-nozzle 15 (ref. FIG. 3D) instantly draws liquid-agent 19 into the delivery-conduit 19" instead of the ambient-air.

In the further Neg.-pressure fluidic circuit iteration of FIG. 2C, is revealed how a pair of dedicated delivery-conduits 19' and 19" alternately cooperate to deliver only ambient-air 21" or liquid-agent 19 into the bubblizer-chamber according to the position of here unported shuttle-valve 18". This FIG. 2C embodiment serves to provide the advantage of eliminating any perceivable lag in operation, as an instant delivery cycle of both the liquid-agent 19 is always in delivery-conduit 19', and air only is facilitated via delivery-conduit 19"; —which is possible only this particular FIG. 2C embodiment. However, it should also be noted that the Pos.-pressure delivery-conduit 19' of FIG. 2A also provides instantaneous delivery, —albeit facilitating liquid-agent 19 only.

Accordingly, there remain subtle, however vital differences as to how the differently pressurized actuator-valves of foregoing FIGS. 2A/2B/2C function relative to the bubblizer-chamber 20, as will become more evident and understood as important improvements. For example, FIGS. 3A/3B/3C/3D further reveal the bubblizer-chamber 20 in side/elevation-view, which is shown for this embodiment of my SudsMix™ invention to preferably be substantially P-shaped as to thus forwardly project, and thereby outwardly protrude somewhat from the supporting surround structure of the 10 hanger-bracket's display-aperture 10' for greater visibility. The bubblizer-chamber. 20 is preferably factory injection-molded of plastic, comprising a front viewing-window 20' portion (preferably hemispherically shaped transparent plastic), while aft portion thereof is preferably molded with vertical planar rear-wall 23 portion can be separately vacuum-plated with a conventional aluminized reflective-substrate mirror-finish coating 23'; —whereupon the two plastic half portions are preferably permanently joined via conventional factory ultrasonically-fusing (or chemically-bonded) as a single hollow unit. The internal mirror finish 23' thereby serving to visually brighten-up the bubblizer-chamber 20 via reflected ambient-light, thus providing enhanced viewing for a bather, —whom upon depressing either pushbutton actuators 17 or 18, can immediately observe (per Ref.-arrow 27) through viewing-window 20' the dynamic bubblizing action resultantly taking place momentarily within the bubblizer-chamber 20.

Reference to the overall shower hanger-bracket 10 apparatus of FIG. 1 reveals how the normally concealed left 19' and right 19" delivery-concuits preferably lead remotely up within their respective conduit-recesses 11R provided by both the left hanger-arm 11' and right hanger-arm 11"; —the delivery-conduits 19' and 19" thus connecting descretely to their respective hose-nipples preferably provided laterally upon the bubblizer-chamber 20. Here, it is to be understood that the bubblizer-chamber 20 is necessarily configured somewhat differently for employment of either the Pos.-pressure type manual metering-pump actuator of FIG. 2A, or for the Neg.-pressure type manual actuators of FIGS. 2B/2C.

Accordingly, the bubblizer-chamber 20 in FIGS. 3A/3B for example, only operates properly in association with a Pos.-pressure type liquid-agent pushbutton actuator of FIG. 2A, owing that the preferably coaxial siphon-nozzle 15 and its interacting siphon-port 15' serve only to essentially carry off the on-going flow of clearwater agitator-jet 15J emitting from divertor-port 15" into bubblizer-chamber 20, then draining via gravity down into anti-chamber 14", where the drained water is rejoined with the out-going water within outlet-passage 14P portion of gooseneck-pipe 14. By providing an air-vent 21' relative to the upper region of anti-chamber 14", it has been found that no water escapes from the gooseneck-pipe 14, yet a near 'ambient' room air-pressure condition is caused to prevail within the bubblizer-chamber 20; —hence, this particular fluidic-circuit arrangement thereby greatly reduces the excessive effort which would otherwise be required of the bather to otherwise overcome the prevailing waterline-pressure, if the liquid-agent were to be pushbutton injected directly into a conventional goosneck-pipe, primarily owing presence of pressure resistive showerhead 13.

Next, the Neg.-pressure actuators of FIG. 2B/2C are solely associated with the fluidic-circuit arrangement set forth in FIGS. 3C/3D, wherein the bubblizer-chamber 20 only operates properly in association with the liquid-agent pushbutton actuator of FIGS. 2B/2C, owing that the preferably coaxial siphon-nozzle 15 and its interacting siphon-port 15' serve only to essentially carry off the on-going flow of clearwater agitator-jet 15J to emitting from diverter-port 15" into bubblizer-chamber 20, and then draining via gravity down into the anti-chamber 14", where the drained water is rejoined with the out-going water within outlet-passage 14P portion of the gooseneck-pipe 14. Note that in this Neg.-pressure fluidic-circuit iteration there is preferably an air-inlet 21" shown provided at the bubblizer-chamber 20 which serves to normally defeat a Neg.-pressure condition therein until shuttle-head 18" of the momentary shuttle-valve 18' in FIG. 2B is biased 25R to left, thereby blocking ambient-air flow 21" and simultaneously unblocking flow via feed-port 19P which in FIG. 3D thus instantly draws awaiting liquid-agent 19 from delivery-conduit 19" past check-valve 19V and into the bubblizer-chamber 20.

Therefore, by following the foregoing explanation of the particular interacting functions between respective FIG. 2A and FIGS. 3A/3B (representing a Pos.-pressure fluidic system), or alternately FIG. 2B and FIGS. 3C/3D (representing a Neg.-pressure fluidic system), it is intended to demonstrate that according to engineering-design preference, either negative or positive fluidic-pressure can be accommodated via my novel bubblizer-chamber 20; —while the purpose of the bubblizer-chamber 20 is to facilitate user selective mixing of the clearwater introduced by the agitator-jet 15J with the liquid-agent 19. However, it will be apparent to those skilled in the art, that the primary objective of both the described fluidic systems, is to perform an effective mixing of the liquid-agent admixture 19 with the clearwater 15J being simultaneously introduced within the bubblizer-chamber 20. Moreover, a further objective of the described fluidic systems shared in common, is to provide the bather with visually. 27 entertaining real-time display information as to the vital admixture event, quickly and easily via the bubblizer-chamber's viewing-window 20'.

Referring next to companion FIGS. 4A/4B shows a further enlarged two-sequence demonstration revealing how the bubblizer-chamber unit 20 is preferably fitted with a novel conically tapered neck 21, which as a male portion can be thus readily dropped into the receiving aspirating-port 13 employing an intimately mating circular tapered female to seat configuration. Note that while such a cooperating tapered male/female connection arrangement is not mandatory, —it does however greatly simplify connecting of the bubblizer-chamber 20 to the horizontal portion of gooseneck-pipe 14, without resorting to the complexity of a conventional screw-threaded coupling to which access is very confined, and time consuming to fuss with; —hence, without this preferred tapered coupling arrangement, maintaining cleanliness of the hanger-bracket 10 assembly would likely pose an aggravating maintenance problem. Accordingly, with the shown aggregation of the gooseneck-pipe 14 employing my novel aspirating-port 14', installation of my SudsMix™ shower hanger-bracket 10 assembly, merely involves unscrewing the original wall situated gooseneck, and then applying Teflon®/plumber's-tape upon the usual inward-terminus screw-threads (not indicated) of gooseneck-pipe 14, then simply screwing it into place with the aspirating-port oriented so that it finally faces upwardly; —then simply placing the hanger-bracket 10 assembly in place via the FIGS. 4A/4B shown tapered connector-neck 21, and installing showerhead 13 to complete the quick and easy installation. Also note in FIG. 4B that a plastic strainer-screen 22' is employed as an optional item along with a few micro-balls 22 (—such as may be hollow thin-walled transparent spheres, or of closed-celled EPS (white expanded-polystyrene) that in any case may be approximately ¼-inch nominal diameter; —which feather-weight bouncing-beads merely serve to enhance the visual display of soap-bubbles being excited by agitator-jet 15J, —particularly when the bather has pressed one of the pushbuttons 17/18.

In FIG. 5 is shown how the various features of the preceding shower installed SudsMix™ apparatus may be generally implemented into a hand-held bathtub bodywash-wand, a hand-held carwash-wand, a conventionally swiveling kitchen-faucet; or as further exemplified here, as a kitchen-sink utility hand-held scrubber-wand 24 for convenient cleansing of dishes, pans, utensils; and preferably includes a manually detachable brush-ring 24', —providing interchangability of bristles 24" ranging in stiffness from soft (for dishes and glass ware) to firm (—for stubborn grime on pots and pans). Other cooperative features include flex-hose 24H (—instead of previously mentioned rigid existing inleting source of hot 12' or cold 12" clearwater), whereby preferably hot ciearwater initially enters into header-chamber 24C where further water flow is normally blocked by a preferable ball type spring-biased (—to 'off'-position as shown) momentary-valve 25, whereby the user is thereby able to selectively cause water to variable flow upon initial movement of appended finger-lever to its 1st-stage 25' (ie: clockwise here), the clearwater thus ensues into the passageway of siphon-nozzle 15 and through the siphon-port 15' whereby in this modality of operation it passes on only as clearwater into the outlet-passage 14P where it emerges into anbiancy past the brush-ring 24' and bristles 24". Note that the fluidic-circuit exemplified here in FIG. 5 is of the Neg.-pressure delivery type, thus substantially according to foregoing FIGS. 2B/3C/3D; —therefore when the user wishes to introduce a soapy-lather, the here preferred finger-lever function must be actuated fully to 2nd-stage position 25", whereby the thus rotating momentary-type rotary-valve 25 becomes sufficiently advanced as to close the normally-open air-inlet 21" duct portion of rotary-valve 25 in fluid-communication with ambient-air. Accordingly, siphon-port 13' is thus no longer able to able to draw ambient-air into the anti-chamber 14", and thus Neg.-pressure is induced within anti-chamber 14' which is fluidicly communicated into bubblizer-chamber 20 via aspirating-port 14' provided for passage of the agitator-jet 15J; thereby resorting to steadily draw a metered amount of liquid-agent 19 from reservoir 16R via delivery-conduit 19". Meanwhile, as was stated for the shower installation embodiment of FIG. 1, a portion of the once flowing clearwater in FIG. 5 is captured via diverter-port 15" to be sent as an agitator-jet 15J plume into the bubblizer-chamber 20, simultaneously with opening of the momentary rotary-valve 25 via manually selective finger action 25L, whilst closing of Neg.-pressure air-vent 21' is preferably integrated into the momentary-valve as shown. Unlike my shower installation embodiment of FIG. 1, the FIG. 5 exemplified scrubber-wand 24 embodiment is shown employing an optional non-protruding viewing-window 20', —which is characterized as an inverted U-shaped configuration, which is smoothly formed flush with the body of the wand, yet is quite visible 27 to the hand-held wand user, whom is typically looking obliquely down at the wand 24. Like the shower installation embodiment of FIG. 1, the fluidic-circuit functionality of this hand-held version nevertheless performs with the same objective of ultimately emitting bubblized water 26 from its substantially equivalent showerhead 13. When the liquid-agent 19 is depleted, a refill-lid 16 or equivalent rubber-cap with vent-hole 16' is merely opened to receive poured-in replenishment of one's preferred liquid-agent 19 from a conventional store purchased bottle.

Thus, it is readily understood how the preferred and generic-variant embodiments of this invention contemplate performing functions in a novel way not heretofore available nor realized. It is implicit that the utility of the foregoing adaptations of this invention are not necessarily dependent upon any prevailing invention patent; and, while the present invention has been well described hereinbefore by way of certain illustrated embodiments, it is to be expected that various changes, alterations, rearrangements, and obvious modifications may be resorted to by those skilled in the art to which it relates, without substantially departing from the implied spirit and scope of the instant invention. Therefore, the invention has been disclosed herein by way of example, and not as imposed limitation, while the appended Claims set out the scope of the invention sought, and are to be construed as broadly as the terminology therein employed permits, reckoning that the invention verily comprehends every use of which it is susceptible. Accordingly, the embodiments of the invention in which an exclusive property or proprietary privilege is claimed, are defined as follows.

What is claimed of proprietary inventive origin is:

1. A fluidic-circuit apparatus installed to a shower gooseneck-pipe for selective conditioning of water streaming from a sprayhead; said apparatus comprising:

at least one liquid-additive container including manual selection means thereto with delivery-conduit connecting to a remote bubblizer-chamber having attachment means fluidicly connecting with an aspirating-port provided upon upper-side of a wall-mounted gooseneck-pipe including a coaxial siphon-nozzle having a diverter-port sending a constant clear-water agitator-jet into said bubblizer-chamber, enters via a connector neck mixing with air from an air inlet which then drains via said connector neck into an anti-chamber proximal said siphon-nozzle whereby the diverted water is drawn back into a stream of line-water flowing through the gooseneck-pipe and outward via a the showerhead, thereby providing a non-bubblizing mode of operation;

and including an alternate bubblizing mode of operation, whereby actuation of said manual selection means delivering said liquid-additive into said bubblizer-chamber which mixes with said air from said air inlet and the constant clear-water agitator-jet and becomes a bubbly-froth, then draining via said connector neck into said anti-chamber where drawn by said siphon-nozzle into stream of line-water flowing through the gooseneck-pipe, whereupon bubblized water is thereby emitted from the showerhead.

2. The fluidic-circuit apparatus according to claim-1, wherein face of said bubblizer-chamber includes a viewing-window portion which may be configured as an outwardly protruding hemisphere of transparent plastic or formed flush with the supporting housing portion, enabling bather to clearly observe bubblizing action which occurs therein.

3. The fluidic-circuit apparatus according to claim-1, wherein said manual selection means is a momentary type outwardly spring-biased pushbutton shuttle-valve including an air-inlet circuit in normal fluid communication with said bubblizer-chamber; whereby depressing said pushbutton closes said air-inlet while simultaneously opening a said reservoir liquid-agent feed-port, whereupon negative-pressure suction generated by said siphon-nozzle draws said liquid-agent into said bubblizer-chamber via a common delivery-conduit.

4. The fluidic-circuit apparatus according to claim-1, wherein said manual selection means is a momentary type outwardly spring-biased pushbutton shuttle-valve which includes an air-inlet in normal fluid communication with said bubblizer-chamber; whereby depressing said pushbutton closes said air-inlet circuit while simultaneously opening a separate said reservoir liquid-agent feed-port circuit, whereupon negative-pressure suction generated by said siphon-nozzle draws said liquid-agent into said to bubblizer-chamber via a separate delivery-conduit.

5. The fluidic-circuit apparatus according to claim-1, wherein said manual selection means is a momentary type pushbutton plunger-valve which is spring biased outwardly to a normally-open position, whereby depressing said pushbutton causes piston-head action to block said reservoir feed-port and send a dose of said liquid-agent into said bubblizer-chamber via positive-pressure.

6. The fluidic-circuit apparatus according to claim-1, wherein said bubblizer-chamber is integrated as part of a hanger-bracket in support of said manual selection pushbutton valve and said liquid-additive container, and a delivery-conduit, all as a unified sub-assembly joined to become wall mounted via said attachment means comprising a connector-neck extending down from said bubblizer-chamber and adapted to mate with said aspirating-port upon top-side of said gooseneck-pipe.

7. The fluidic-circuit apparatus according to claim-1, wherein said water diverter-port is an orifice approximately 1/32nd-inch to 3/32nd-inch in diameter formed into the upper-wall portion of said siphon-nozzle.

8. The fluidic-circuit apparatus according to claim-1, wherein said bubblizer-chamber fluidic attachment means is an optionally tapered connector-neck mounting vertically down intimately into said aspirating-port of gooseneck-pipe, thereby serving to conveniently mate a hanger-bracket sub-assembly portion of the apparatus to wall supported gooseneck-pipe without aid of tools.

9. The fluidic-circuit apparatus according to claim-1, wherein said anti-chamber or said bubblizer-chamber includes an air-inlet, whereby ambient-air is thus drawn in by said siphon-nozzle enabling easy positive-pressure type operation of said pushbutton disassociated from the high-pressure of the main waterline.

10. The fluidic-circuit apparatus according to claim-1, wherein said bubblizer-chamber includes an air-inlet in fluid-communication with said negative-pressurized anti-chamber, thereby enabling said liquid-additive to be drawn from remote said reservoir section upon user biasing of said manual selection means.

11. The fluidic-circuit apparatus according to claim-1, wherein said bubblizer-chamber includes at least one conduit in fluid-communication with a said liquid-additive reservoir, whereto is also included a one-way low-threshold check-valve serving to resist seepage-flow of said liquid-additive.

12. The fluidic-circuit apparatus according to claim-1, wherein the aft internal-surface of said bubblizer-chamber is coated with a mirror-like reflective-substrate, thereby reflecting ambient-light to visually brighten confines of said bubblizer-chamber.

13. The fluidic-circuit apparatus according to claim-1, wherein said bubblizer-chamber contains several tiny plastic floatation-balls of approximate ¼-inch diameter which when hit by force of said agitator-jet are caused to dance around therein, thereby providing an artificially enhanced illusion of soap-bubbles.

14. A fluidic-circuit for a hand-portable wand like apparatus to condition water from an existing bathroom or other waterline faucet-valve; said apparatus comprising:

an elongate housing having an inlet connected to a water hose, and an outlet arranged at opposite distal end along a longitudinal-axis, whereto is provided a through passageway for normal clear-water usage;

and proximally including a coaxial siphon-nozzle having an approximate right-angle diverter-port sending a constant clear-water agitator-jet into an abaxial bubblizer-chamber through an aspirating-port mixing with air from an air vent which then drains via the aspirating-port into an anti-chamber where drawn back into the stream of line-water and finally outward, thereby constituting a 1st mode of operation;

and including a 2nd mode of operation, whereby a liquid-additive contained within a reservoir section is sent via delivery-conduit into said bubblizer-chamber upon selective manual biasing of a pushbutton-valve or trigger actuated equivalent thereof, which then mixes with said air from said air vent and the constant clear-water agitator-jet and becomes a bubbly-froth, then draining via said aspirating port into said anti-chamber where drawn by said siphon-nozzle into coaxial stream from line-water, whereupon bubblized water finally emerges via a showerhead or equivalent outlet at distal end of the wand.

15. The fluidic-circuit according to claim-14, wherein said manual selection means is a momentary type shuttle-valve which is spring-biased outwardly to normally off position blocking flow of linewater, and whereby depressing said shuttle-valve to a 1st-stage position opens an air-inlet enabling negative-pressure generated by said siphon-nozzle to draw ambient-air into fluid-communication with said bubblizer-chamber, thereby negating flow of said liquid-agent from said reservoir.

16. The fluidic-circuit according to claim-15, wherein said shuttle-valve includes a 2nd-stage position maintaining flow of linewater through the wand while simultaneously closing said air-inlet circuit, thereby enabling said siphon-nozzle to draw liquid-agent from said reservoir into said bubblizer-chamber.

17. The invention apparatus according to claim-14, wherein said water diverter-port is an orifice approximately 1/32nd-inch to approximately 3/32nd-inch in diameter formed into upper-wall portion of said siphon-nozzle.

18. A method of previewing a novel bubblizing action within a fluidic-circuit connected to an existing pressurized water-line; said method comprising:

providing a liquid-additive reservoir-in discrete fluid-communication with a selectively actuatable pushbutton delivery means feeding a bubblizer-chamber cooperating with a siphon-nozzle having a diverter-port shooting a constant clear-water agitator-jet of clear-water into said bubblizer-chamber via a connector-neck which mixes with air from an air inlet which then drains via said connector-neck into an anti-chamber and is drawn back into the primary water-stream and finally outward; whereby user can thus actuate said pushbutton to deliver a dose of said liquid-additive into said bubblizer-chamber provided with a transparent window whereby user can observe said constant clear-water agitator-jet caused bubblizing-action occurring within said bubblizer-chamber until said dose of liquid-agent becomes depleted therein after mixing with said air from said air inlet and the constant clear-water agitator-jet and draining via said connector-neck into said anti-chamber.

19. The fluidic-circuit method according to claim-18, wherein said pushbutton delivery means is a shuttle-valve which is spring biased to a normally-closed position, whereby depressing said pushbutton simultaneously closes an ambient air-inlet circuit while opening a feed-port of said reservoir, whereby negative-pressure generated by said siphon-nozzle draws said liquid-agent into said bubblizer-chamber.

20. The fluidic-circuit method according to claim-18, wherein said selectively actuatable pushbutton delivery means is a plunger-valve which is spring biased outwardly to a normally-closed position, and depressing said pushbutton causes piston-head action to feed a dose of said liquid-agent into said bubblizer-chamber via positive-pressure.

* * * * *